US008983321B2

(12) United States Patent
Silcoff et al.

(10) Patent No.: US 8,983,321 B2
(45) Date of Patent: Mar. 17, 2015

(54) FLUID DELIVERY SYSTEM AND METHOD THEREOF

(75) Inventors: Elliad Silcoff, Tel Aviv (IL); Eyal Bachar, Modi'in (IL); Kobi Shkuri, Kiryat Weizmann Nes Ziona (IL); Nava Klein, Rishon Le Tzion (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 40 days.

(21) Appl. No.: 13/816,467

(22) PCT Filed: Aug. 20, 2010

(86) PCT No.: PCT/US2010/046169

§ 371 (c)(1), (2), (4) Date: Feb. 11, 2013

(87) PCT Pub. No.: WO2012/023946

PCT Pub. Date: Feb. 23, 2012

(65) Prior Publication Data

US 2013/0148989 A1 Jun. 13, 2013

(51) Int. Cl.

| | |
|---|---|
| ***G03G 15/10*** | (2006.01) |
| ***G03G 15/00*** | (2006.01) |
| ***B41J 2/175*** | (2006.01) |
| ***B41J 2/18*** | (2006.01) |
| ***B41J 2/185*** | (2006.01) |

(52) U.S. Cl.

CPC ..... *G03G 15/50* (2013.01); *G03G 15/104* (2013.01); *B41J 2/175* (2013.01); *B41J 2/18* (2013.01); *B41J 2/185* (2013.01)

USPC ..... 399/57

(58) Field of Classification Search

CPC ..... G03G 15/104

USPC ..... 399/57, 238

See application file for complete search history.

(56) References Cited

U.S. PATENT DOCUMENTS

| | | | | |
|---|---|---|---|---|
| 4,860,924 | A | 8/1989 | Simms et al. | |
| 5,003,352 | A | 3/1991 | Duchesne et al. | |
| 5,231,454 | A | 7/1993 | Landa | |
| 5,278,615 | A | 1/1994 | Landa | |
| 5,724,629 | A * | 3/1998 | Iino et al. | 399/57 |
| 2007/0140742 | A1 * | 6/2007 | Slattery et al. | 399/253 |

FOREIGN PATENT DOCUMENTS

| | | | |
|---|---|---|---|
| CN | 101256380 | | 9/2008 |
| JP | 11-065295 | * | 3/1999 |

OTHER PUBLICATIONS

PCT Search Report~Application No. PCT/US2010/046169 dated May 24, 2011.

* cited by examiner

*Primary Examiner* — Sandra Brase

(74) *Attorney, Agent, or Firm* — Hewlett-Packard Patent Department

(57) ABSTRACT

A method includes controlling a charge level of fluid in a fluid chamber by detecting at least one fluid parameter corresponding to a charge level of a fluid in a fluid chamber having at least charge directors and carrier liquid, and controlling the charge level of the fluid based on the detected fluid parameter.

15 Claims, 7 Drawing Sheets

FLUID DELIVERY SYSTEM AND METHOD THEREOF

BACKGROUND

Fluid delivery systems for image forming apparatuses such as liquid electrophotography printing apparatuses include providing liquid toner to fluid applicators. Subsequently, the fluid applicators provide the charged liquid toner to an image transfer member that receives images formed by the image forming apparatuses and transfer the images onto substrates such as print media. Generally, the liquid toner includes charge directors to electrically charge the liquid toner.

BRIEF DESCRIPTION OF THE DRAWINGS

Exemplary non-limiting embodiments of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

FIGS. 3A and 38 are perspective views of charge reducing units of the fluid delivery system of FIG. 2B according to examples of the present disclosure.

DETAILED DESCRIPTION

In the following detailed description, reference is made to the accompanying drawings which form a part hereof, and in which is depicted by way of illustration specific embodiments in which the present disclosure may be practiced. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Fluid delivery systems for image forming apparatuses such as liquid electrophotography printing apparatuses provide charged liquid toner including charge directors and a carrier fluid to fluid applicators such as binary ink developers (BIDS) of the liquid electrophotography apparatuses. A fluid chamber receives each of the charge directors and carrier fluid forming the charged liquid toner and subsequently provides the charged liquid toner to a respective BID. The BID provides the charged liquid toner to a latent image on a photo imaging member, which in turn provides the image to an image transfer member such as an image transfer blanket. The image transfer blanket transfers the image onto a substrate such as print media. The fluid delivery system may include multiple fluid chambers in fluid communication with corresponding BIDS in which each fluid chamber with its corresponding BID may correspond to a different color fluid to enable color printing.

At times, however, a charge level of the liquid toner in the fluid chamber may change in a manner in which the charge level is no longer within a range recommended, for example, for the liquid toner to be sufficiently transferred to and from the intermediate transfer member. The charge level may rise above the recommended range due to, for example, an accumulation of charge directors on the photo imaging member as a result of periodic cleaning processes thereof, an accumulation of charge directors remaining in fluid chamber, and/or printing side effects such as electrical fatigue. Such a rise in charge level may contribute to printing defects resulting in printed images of an inferior image quality. In examples of the present disclosure, a fluid delivery system is disclosed to prevent inferior quality images from being printed and stabilize optical density. A fluid delivery system is disclosed to maintain the charge level of the fluid in the fluid chamber within a predetermined range, for example, by changing a concentration of an amount of charge directors in the fluid. A charge reducing unit is configured to decrease the charge level of the fluid of the fluid chamber and a charge increasing unit is configured to increase the charge level of the fluid based on based on a detection of at least one fluid parameter corresponding to the charge level of the fluid of the fluid chamber.

Figure 1:
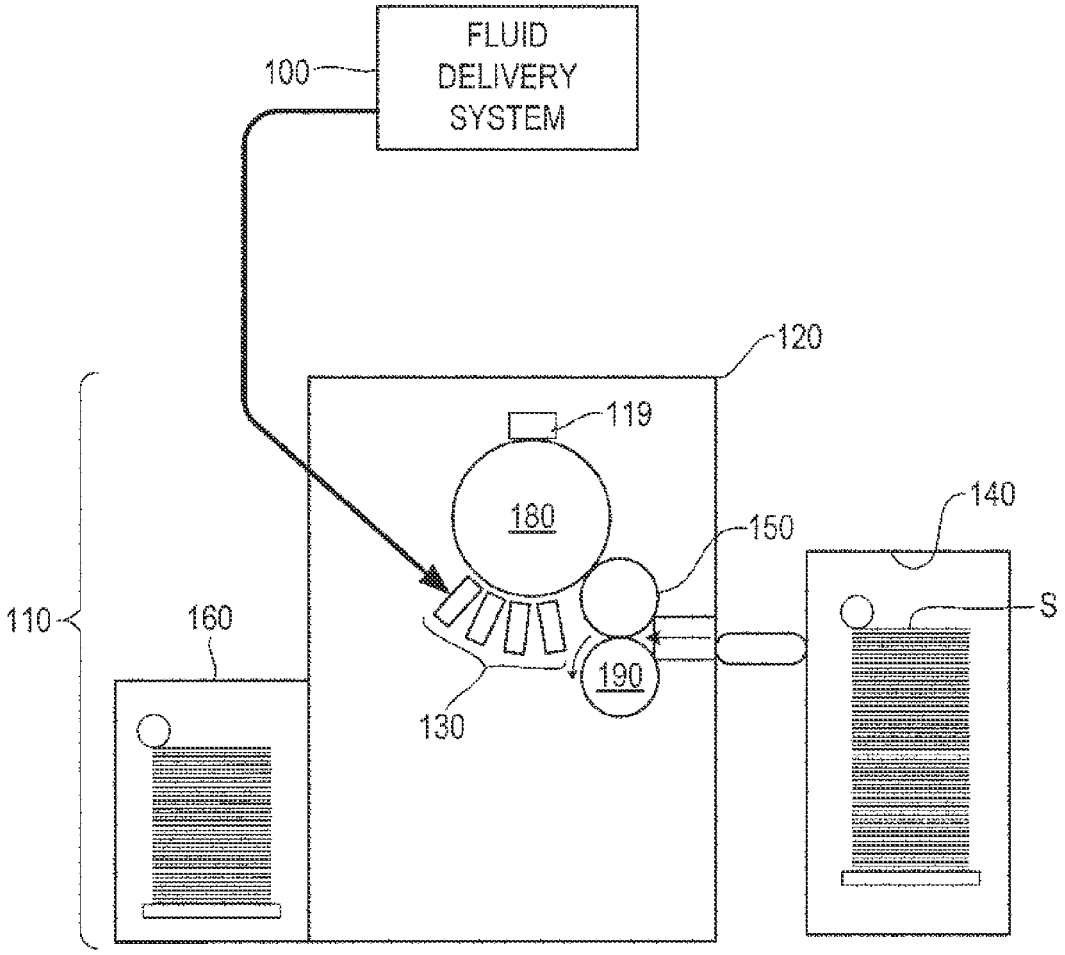
FIG. 1 is a schematic view illustrating a fluid delivery system in communication with an exemplary liquid electrophotography printing apparatus according to an example of the present disclosure.

FIG. 1 is a schematic view illustrating a fluid delivery system in communication with an exemplary liquid electrophotography printing apparatus according to an example of the present disclosure. Referring to FIG. 1, a fluid deliver system 100 is usable with an image forming apparatus such as a liquid electrophotography printing apparatus (LEP) 110. As illustrated in FIG. 1, the LEP 110 includes an image forming unit 120 that receives a substrate S such as a print media from an input unit 140 and outputs the substrate S to an output unit 160. The image forming unit 120 includes a photo imaging member (PIP) 180 that defines an outer surface on which images can be formed. The outer surface may be charged with a suitable charger (not illustrated), such as a charge roller, and portions of the outer surface that correspond to features of the image can be selectively discharged by a laser writing unit 119 to form an electrostatic image on the outer surface.

Referring to FIG. 1, a fluid delivery system 100 may supply fluid such as liquid toner, for example, Electroink, trademarked by Hewlett-Packard Company, to fluid development units of the LEP 110 such as BIDs 130. The BIDs 130 apply the fluid to the electrostatic image to form a fluid image on the cuter surface of the PIP 180 to be transferred to an intermediate transfer member (ITM) 150. The ITM 150 is configured to receive the fluid image from the PIP 180, heat the image, and transfer the image to the substrate S. During the transfer from the ITM 150 to the substrate S, the substrate S is pinched between the ITM 150 and an impression member 190. Once the fluid image has been transferred to the substrate S, the substrate S can be transported to the output unit 160.

Figure 2A:
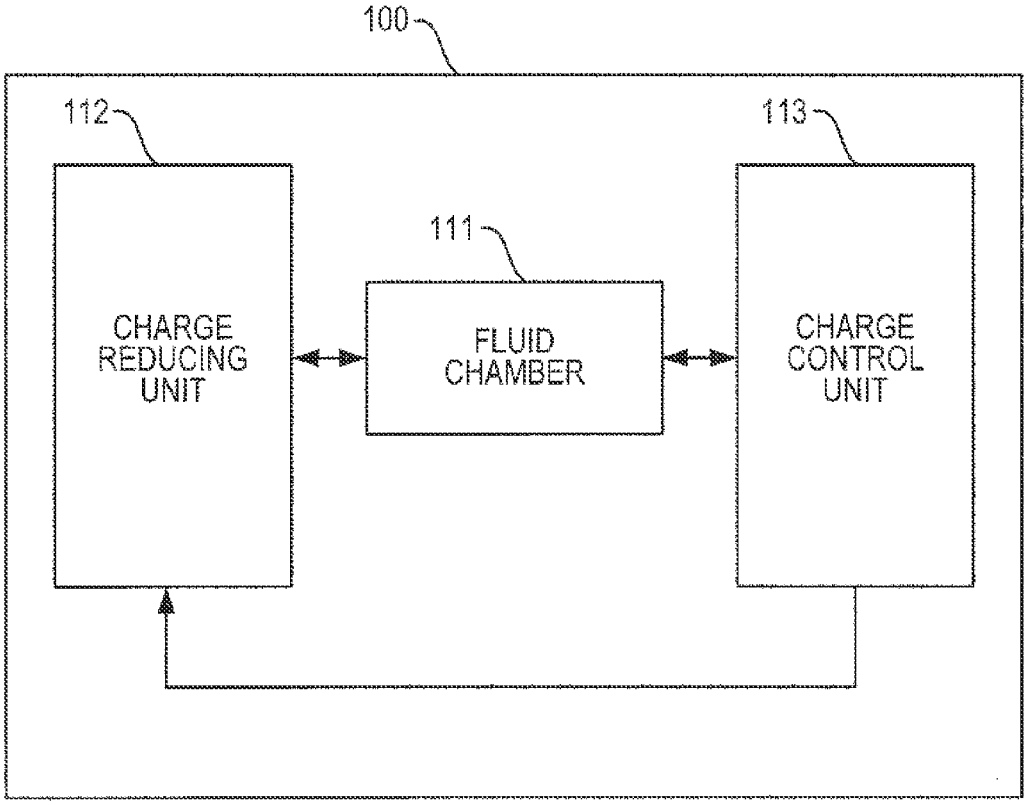
FIG. 2A is a block diagram illustrating a fluid delivery system according to an example of the present disclosure.

FIG. 2A is a block diagram illustrating a fluid delivery system according to an example of the present disclosure. Referring to FIG. 2A, a fluid delivery system 100 includes a fluid chamber 111, a charge reducing unit 112, and a charge control unit 113. In an example, the fluid delivery system 100 may be disposed within the image forming apparatus 110. In other examples, the fluid delivery system 100 may be external to the image forming apparatus 110. In the present example, the fluid chamber 111 is configured to store fluid having at least charge directors and a carrier liquid. In examples, the fluid chamber 111 may be a reservoir, ink tank, or the like. In an example, the fluid may also be supplied to a LEP 110 to print images on a substrate S (FIGS. 1 and 2B) and/or used as a cleaning fluid for the PIP 180, or the like. The charge reducing unit 112 is in fluid communication with the fluid chamber 111. The charge reducing unit 112 is configured to decrease a charge level of the fluid of the fluid chamber 111. The charge control unit 113 is in communication with the fluid chamber 111 and is configured to control the charge level of the fluid based on a detection of at least one fluid parameter corresponding to the charge level of the fluid of the fluid chamber 111. In an example, the charge reducing unit 112 reduces a concentration of an amount of the charge directors in the fluid of the fluid chamber 111. In an example, the charge directors, that is, charge control agents, may include one or more of lecithin, barium sulfocuccinate, or the like.

Figure 2B:
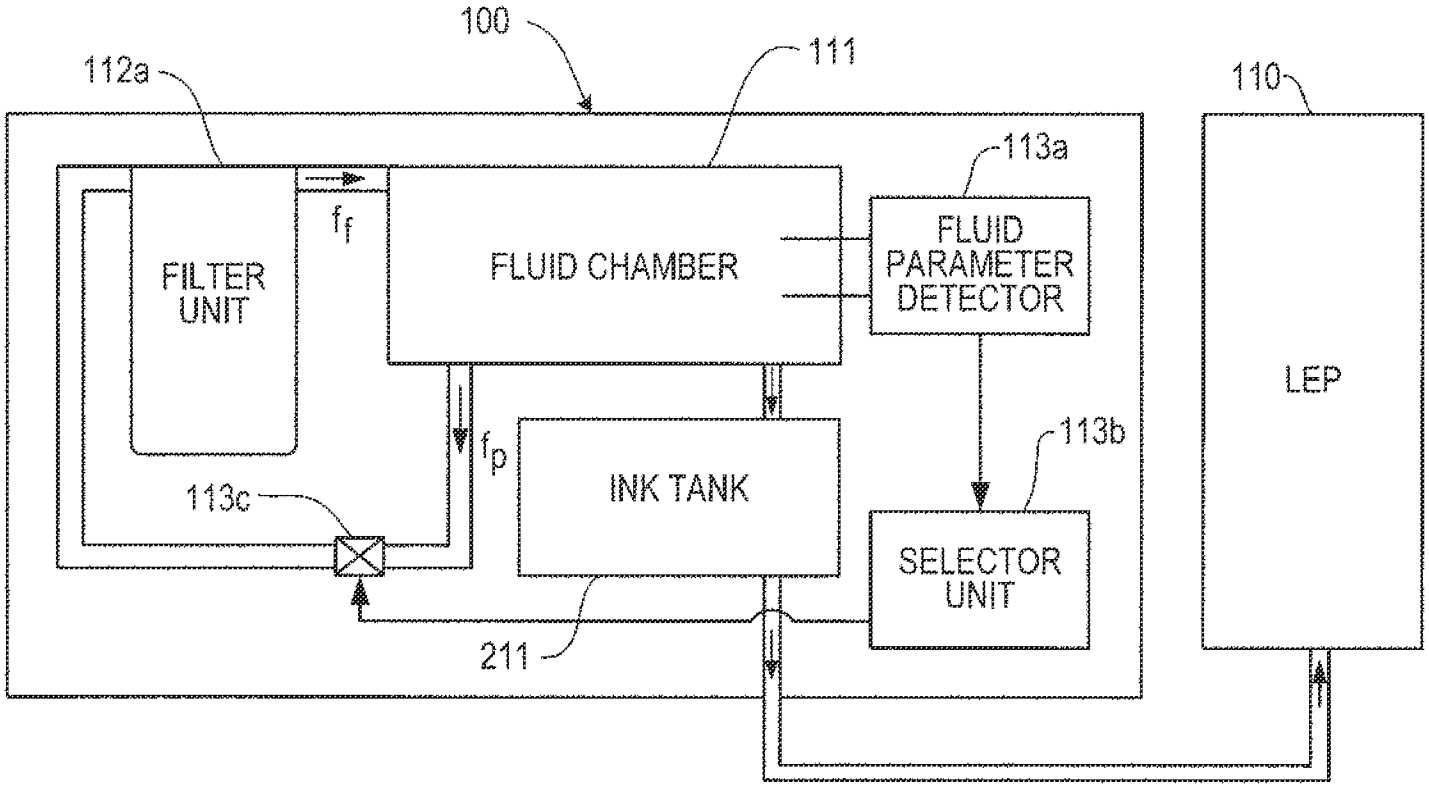
FIG. 2B is a partial side view illustrating the fluid delivery system of FIG. 2A according to an example of the present disclosure.

FIG. 2B is a partial side view illustrating the fluid delivery system of FIG. 2A according to an example of the present disclosure. Referring to FIGS. 2A and 2B, in an example, the charge reducing unit 112 includes a filter unit 112*a* configured to remove charge directors from the fluid by adsorption with the fluid $f_p$ entering the filter unit 112*a* to form a filtered fluid $f_f$, and provide the filtered fluid $f_f$ to the fluid chamber 111. As illustrated in FIG. 2B, the charge control unit 113 includes a fluid parameter detector 113*a* configured to detect the at least one fluid parameter corresponding to the charge level of the fluid. For example, the at least one fluid parameter may be conductivity. In an example, the charge control unit 113 may also include a selector unit 113*b* configured to place the charge reducing unit 112 such as the filter unit 112*a* in or out of fluid communication with the fluid chamber 111 based on the detection of the at least one fluid parameter such as the conductivity of the fluid.

In an example, a predetermined range for the conductivity may be 70 to 110 picoseimens per centimeter (pS/cm). Thus, for example, when the fluid parameter detector 113*a* detects the conductivity of the fluid exceeding 110 pS/cm, the selector unit 113*b* may place the filter unit 112*a* in fluid communication with the fluid chamber 111 to reduce the charge level of the fluid. For example, the selector unit 113*b* may open an automated control valve 113*c*, or the like, disposed between the filter unit 112*a* and the fluid chamber 111 to enable the filter unit 112*a* to remove the charge directors from the fluid passing therethrough. The fluid parameter detector 113*a* may be a conductivity sensor disposed on the fluid chamber 111. The fluid chamber 111 may further include a pump (not illustrated), additional sensors (not illustrated) such as a density sensor, level sensor and temperature sensor, and a fluid temperature controller such as a heater or a cooler. As illustrated in FIG. 2B, the fluid delivery system 100 may also include an ink tank 211 configured to receive fluid from the fluid chamber 111 and toner concentrate 115*a* (FIG. 4B) to form a printing fluid. The ink tank 211 may also be in fluid communication with the LEP 110, to provide the printing fluid to a respective BID 130 (FIG. 1) of the LEP 110 to print images therewith.

Figure 3A:
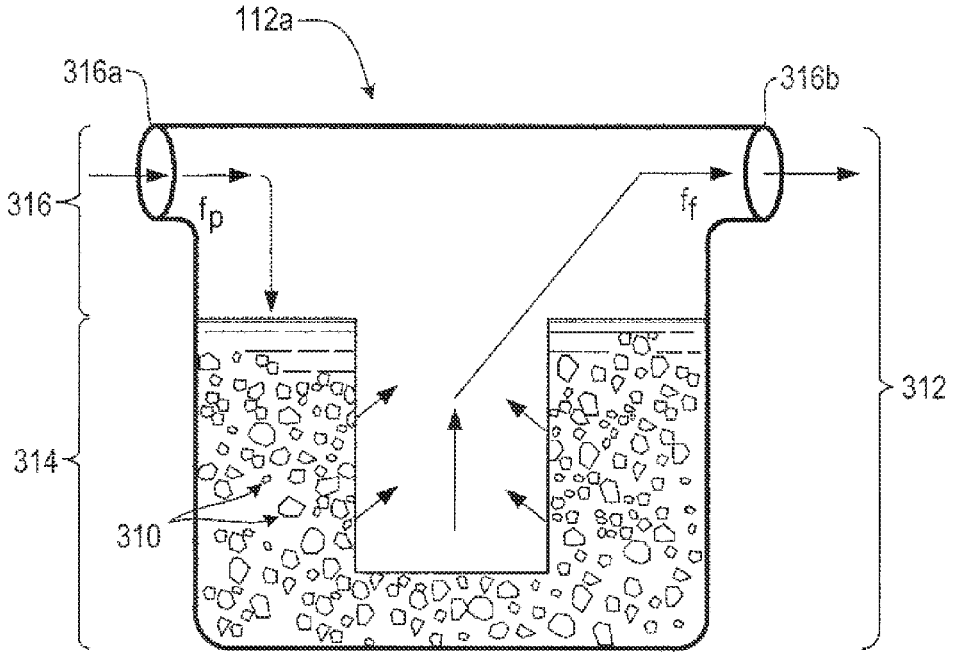
Figure 3B:
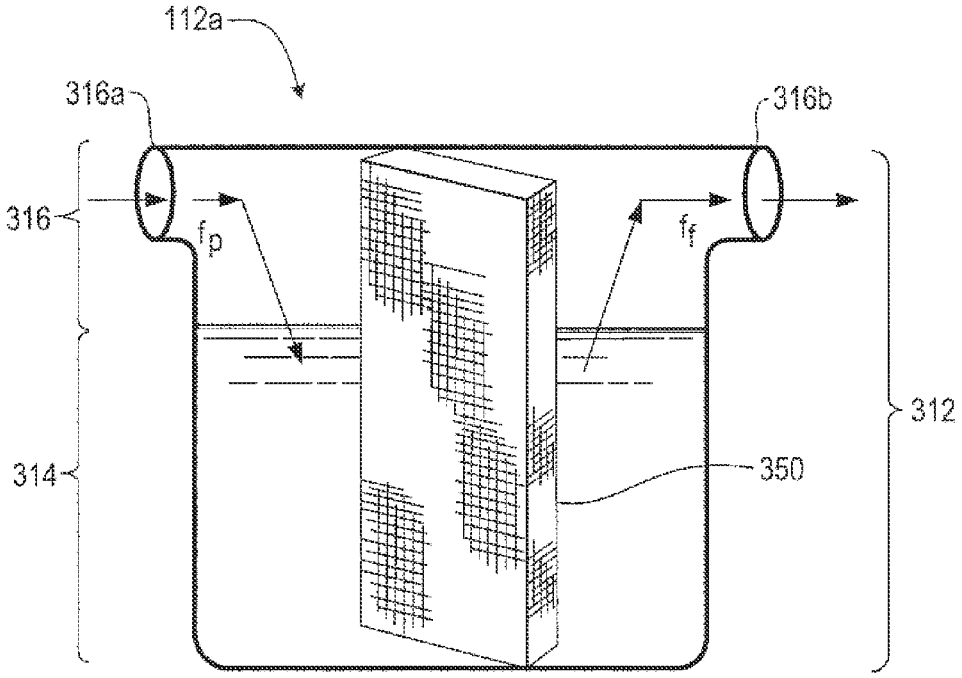

FIGS. 3A and 3B are perspective views of charge reducing units of the fluid delivery system of FIG. 2B according to examples of the present disclosure. Referring to FIGS. 3A and 3B, the filter unit 112*a* may include at least one of silica gel 310 (FIG. 3A) and a mono-directional membrane 350 (FIG. 3B). Referring to FIG. 3A, in an example, the filter unit 112*a* may include a silica gel 310 and a housing unit 312 to store the silica gel 310. The housing unit 312 may include a removable portion 314 in which the silica gel 310 can be removably stored, and a stationary portion 316 having an inlet 316*a* and outlet 316*b* in fluid communication with the removable portion 314 and the silica gel 310 stored therein. The silica gel 310 may be replaced as needed. In an example, the fluid $f_p$ from the fluid chamber 111 enters the inlet 316*a* of the stationary portion 316 of the filter unit 112*a*. Subsequently, the fluid $f_p$ flows into the removable portion 314 of the filter unit 112*a* and comes in contact with the silica gel 310. The silica gel 310 filters the fluid by attracting to its surface solids such as charge directors. The filtered fluid $f_f$ having a reduced amount and/or no charge directors therein, flows out of the outlet 316*b* of the stationary portion 316 of the filter unit 112*a*, and into the fluid chamber 111. In the fluid chamber 111, the filtered fluid $f_f$ mixes together with the rest of the fluid therein resulting in a reduction of the concentration of the amount of charge directors in the fluid stored in the fluid chamber 111.

In other examples, the housing unit 312 may include a mono-directional membrane 350 stored therein in which the mono-directional membrane 350 and/or the housing unit 312, or a portion thereof, is replaceable as illustrated in FIG. 3B. Referring to FIG. 3B, the fluid $f_p$ from the fluid chamber 111 is directed through the mono-directional membrane 350 in order to remove charge directors therefrom resulting in the filtered fluid $f_f$. The filtered fluid $f_f$ having a lower concentration of the amount of the charge directors than the fluid in the fluid chamber 111 is directed into the fluid chamber 111.

Figure 4A:
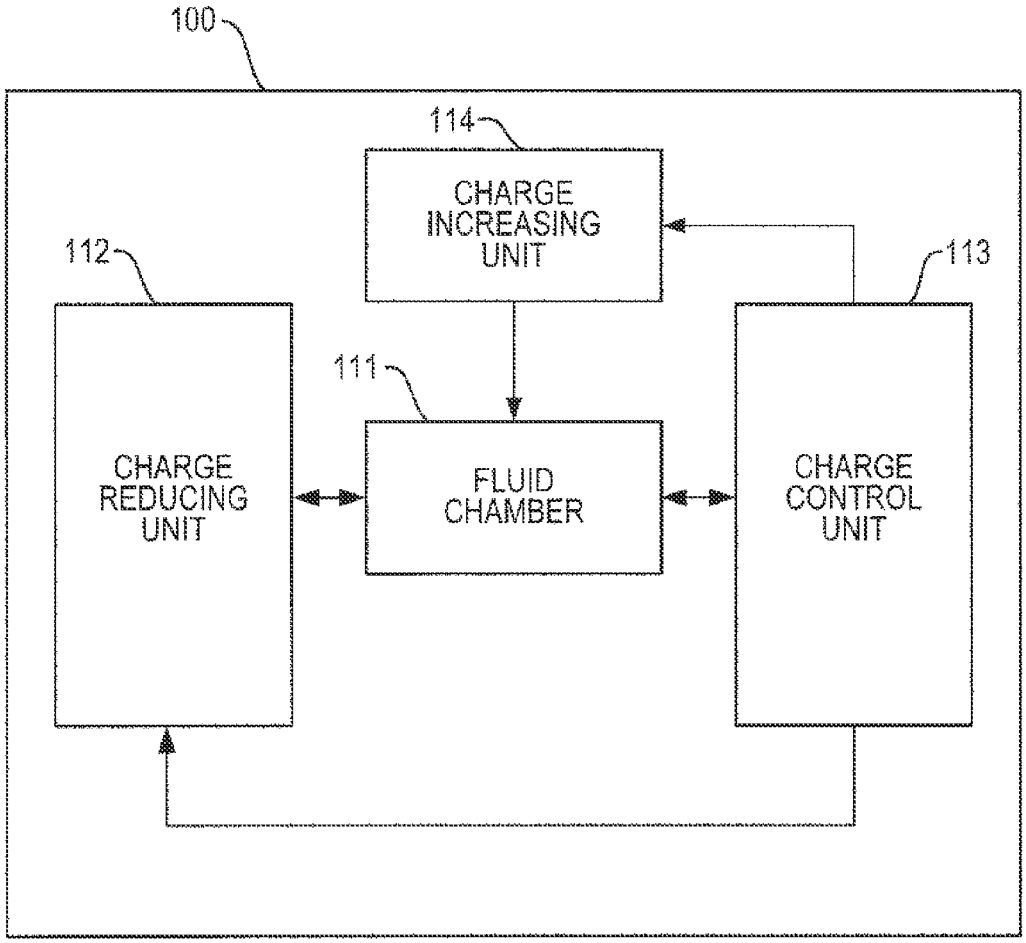
FIG. 4A is a block diagram illustrating a fluid delivery system of FIG. 2A according to an example of the present disclosure.

FIG. 4A is a block diagram illustrating a fluid delivery system of FIG. 2A according to an example of the present disclosure. Referring to FIG. 4A, in an example, a fluid delivery system 100 includes a fluid chamber 111, a charge reducing unit 112, a charge increasing unit 114, and a charge control unit 113. In the present example, the fluid chamber 111 is configured to store fluid having at least charge directors and a carrier liquid. The charge reducing unit 112 is in fluid communication with the fluid chamber 111. The charge reducing unit 112 is configured to decrease a charge level of the fluid of the fluid chamber 111. In an example, the charge reducing unit 112 reduces a concentration of an amount of the charge directors in the fluid of the fluid chamber 111. The charge control unit 113 is in communication with the fluid chamber 111, the charge reducing unit 112, and the charge increasing unit 114.

Figure 4B:
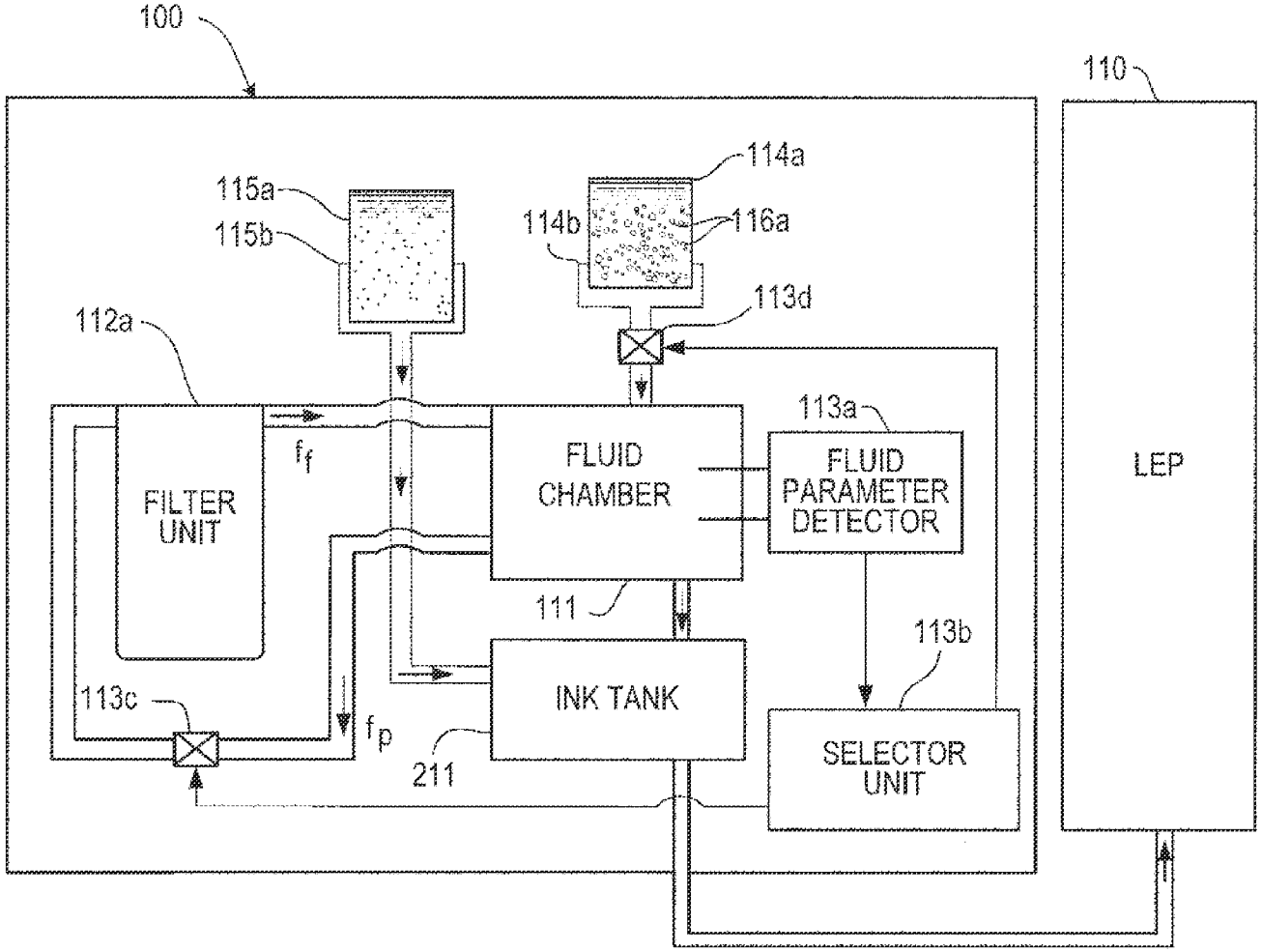
FIG. 4B is a partial side view illustrating the fluid delivery system of FIG. 4A according to an example of the present disclosure.

Referring to FIG. 4A, in an example, the charge increasing unit 114 of the fluid delivery system 100 is in fluid communication with the fluid chamber 111 and in communication with the charge control unit 113. In an example, the charge increasing unit 114 is configured to increase the charge level of the fluid of the fluid chamber 111. In an example, the charge increasing unit 114 increases a concentration of the amount of the charge directors in the fluid of the fluid chamber 111. For example, the charge increasing unit 114 may provide a supplemental fluid 114*a* (FIG. 4B) to the fluid of the fluid chamber 111 such that the concentration of the amount of charge directors of the supplemental fluid 114*a* is greater than the concentration of the amount of the charge directors of the fluid in the fluid chamber 111 at the time of the detection of the at least one fluid parameter. In an example, the charge increasing unit 114 may include the supplemental fluid 114*a* and a supplemental fluid receptacle 114*b* configured to removable receive the supplemental fluid 114*a* as illustrated in FIG. 4B. In an example, the supplemental fluid 114*a* may be primarily imaging oil such as ISOPAR, trademarked by Exxon Corporation, having a charge director compound dispersed therein, a toner concentrate 115*a* having charge directors and toner particles mixed therein, and/or primarily a charge director compound 116*a* in a solution. The supplemental fluid 114*a* may be replaced as needed.

Referring to FIG. 4A, in an example, the charge control unit 113 is in communication with the fluid chamber 111, the charge reducing unit 112 and the charge increasing unit 114. In the present example, the charge control unit 113 is configured to control the charge level of the fluid based on a detection of at least one fluid parameter corresponding to the charge level of the fluid of the fluid chamber 111. FIG. 4B is a partial side view illustrating the fluid delivery system of FIG. 4A according to an example of the present disclosure. Referring to FIGS. 4A and 4B, in an example, the charge reducing unit 112 includes a filter unit 112*a* configured to remove charge directors from the fluid by adsorption with the fluid $f_p$ entering the filter unit 112*a* to form a filtered fluid $f_f$ having a lower concentration of an amount of charge directors than the fluid in the fluid chamber 111. Subsequently, the filtered fluid $f_f$ is directed from the filter unit 112*a* to the fluid chamber 111. As illustrated in FIG. 4B, the charge control unit 113 includes a fluid parameter detector 113*a* configured to detect the at least one fluid parameter such as conductivity corresponding to the charge level of the fluid.

Referring to FIG. 4B, the charge control unit 113 may also include a selector unit 113*b* configured to place the charge reducing unit 112 such as the filter unit 112*a* and the charge increasing unit 114 such as the supplemental fluid 114*a* in or out of fluid communication with the fluid chamber 111 based on the detection of the at least one fluid parameter. For example, when the fluid parameter detector 113*a* detects the conductivity of the fluid below 70 pS/cm, the selector unit 113*b* may place the fluid chamber 111 in fluid communication with the supplemental fluid 114*a* having a higher concentration of the amount of the charge directors than the fluid in the fluid chamber 111 to mix with the fluid therein. For example, the selector unit 113*b* may open an automatic control valve 113*d*, or the like, disposed between the supplemental fluid 114*a* and the fluid chamber 111. Thus, in the fluid chamber 111, the filtered fluid $f_f$ mixes together with the rest of the fluid resulting in a reduction of the concentration of the amount of charge directors in the fluid stored in the fluid chamber 111. Accordingly, the supplemental fluid 114*a* may be primarily imaging oil such as ISOPAR having a charge director compound dispersed therein, a toner concentrate 115*a* having charge directors and toner particles mixed therein, and/or primarily a charge director compound 116*a* in solution. In an example, the supplemental fluid 114*a* includes the imaging oil having a concentration of an amount of charge directors of approximately 0.075%.

Referring to FIG. 4B, the fluid delivery system 100 may also include an ink tank 211 configured to receive fluid from the fluid chamber 111 and toner concentrate 115*a* to form a printing fluid. The ink tank 211 may also be in fluid communication with the LEP 110, to provide the printing fluid to a respective BID 130 (FIG. 1) of the LEP 110 to print images therewith. In an example, the fluid delivery system 100 may include other fluid receptacles 115*b* in addition to the supplemental fluid receptacle 114*b* to receivable mount, for example, the toner concentrate 115*a*. In an example, the toner concentrate 115*a* supplies color pigments to the fluid to correspond with a desired color. In an example, the toner concentrate 115*a* may include 21.5% solids.

In other examples, the selector unit 113*b* may additionally place the filter unit 112*a* out of fluid communication with the fluid chamber 111 in response to the detection of the conductivity below 70 pS/cm. For example, the selector unit 113*b* may close an automated control valve 113*c*, or the like, disposed between the fluid chamber 111 and the charge reducing unit 112. In an example, the selector unit 113*b* may select the charge reducing unit 112 to be in fluid communication with the fluid chamber 111 when the conductivity is greater than 110 pS/cm, and select the charge increasing unit 114 to be in fluid communication with the fluid chamber 111 when the conductivity is less than 70 pS/cm. As illustrated in FIG. 4B, the fluid chamber 111 of the fluid delivery system 100 may also be in fluid communication with the LEP 110, for example, through the ink tank 211, to provide the fluid to a respective the BID 130 (FIG. 1).

Figure 5:
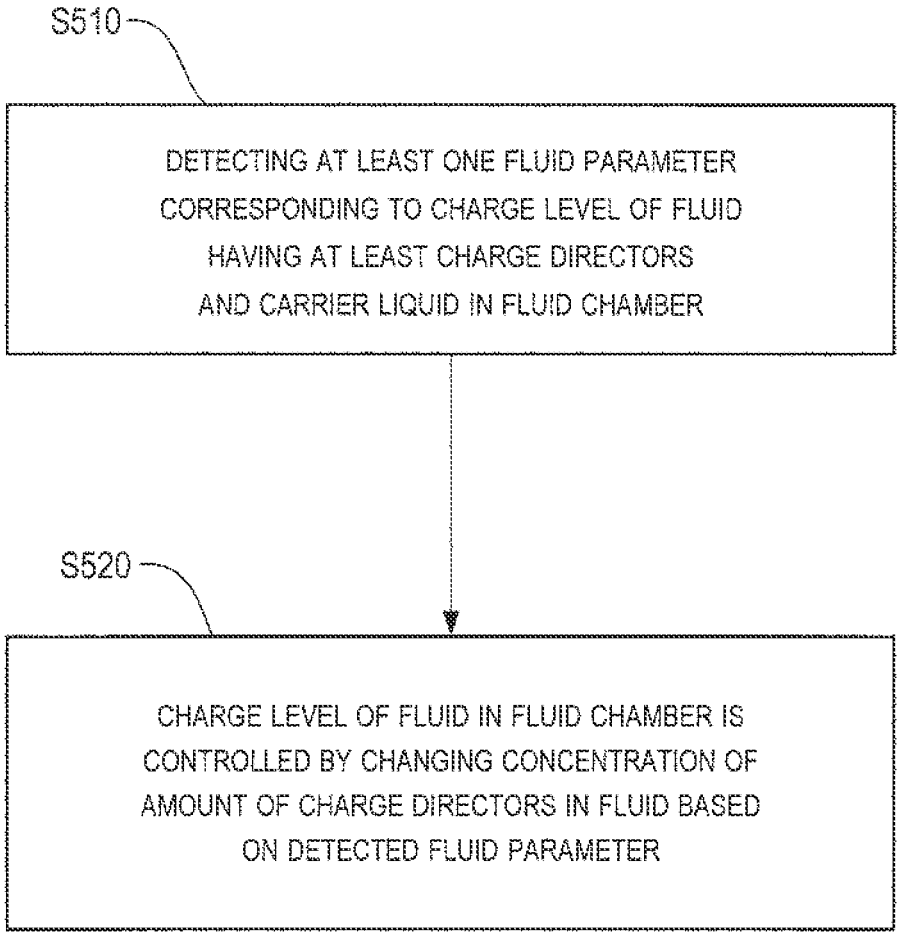
FIG. 5 is a flowchart illustrating a method of controlling a charge level of fluid in a fluid chamber of a fluid delivery system according to an example of the present disclosure.

FIG. 5 is a flowchart illustrating a method of controlling a charge level of fluid in a fluid chamber of a fluid delivery system 100 according to an example of the present disclosure. Referring to FIGS. 4A, 4B and 5, in block 510, at least one fluid parameter corresponding to a charge level of a fluid having at least charge directors and carrier liquid in a fluid chamber is detected. In an example, the at least one parameter may be conductivity and a predetermined range of the conductivity of the fluid may be in a range of 70 pS/cm to 110 pS/cm.

In block 520, the charge level of the fluid in the fluid container is controlled by changing a concentration of an amount of the charge directors in the fluid based on the detected fluid parameter. For example, a charge control unit may control the charge level of the fluid by selecting at least one of a charge reducing unit and a charge increasing unit to be in fluid communication with the fluid chamber based on the detected at least one fluid parameter of the fluid. In an example, the charge reducing unit may reduce the concentration of the amount of the charge directors in the fluid and the charge increasing unit may increase the concentration of the amount of the charge directors in the fluid. In an example, the charge control unit may select the charge reducing unit when the detected fluid parameter is greater than 110 pS/cm and may select the charge increasing unit when the detected fluid parameter is less than 70 pS/cm. The concentration of the amount of the charge directors in the fluid may be reduced by a filter unit removing respective charge directors from the fluid by adsorption. In examples, the filter unit 112*a* may include at least one of a silica gel and a mono-directional membrane (FIGS. 3A and 3B).

The present disclosure has been described using non-limiting detailed descriptions of example embodiments thereof that are provided by way of example and are not intended to limit the scope of the present disclosure. It should be understood that features and/or operations described with respect to one example may be used with other examples and that not all examples of the present disclosure have all of the features and/or operations illustrated in a particular figure or described with respect to one of the embodiments. Variations of embodiments described will occur to persons of the art. Furthermore, the terms "comprise," "include," "have" and their conjugates, shall mean, when used in the present disclosure and/or claims, "including but not necessarily limited to."

It is noted that some of the above described embodiments may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A fluid delivery system usable with a liquid electrophotography printing apparatus, the system comprising:

a fluid chamber configured to store fluid having at least charge directors and a carrier liquid;

a charge reducing unit in communication with the fluid chamber, the charge reducing unit configured to decrease a charge level of the fluid of the fluid chamber, and the charge reducing unit configured to reduce a concentration of an amount of the charge directors in the fluid of the fluid chamber by removing the charge directors from the fluid; and a charge control unit in communication with the fluid chamber and the charge reducing unit, the charge control unit configured to control the charge level of the fluid based on a detection of at least one fluid parameter corresponding to the charge level of the fluid of the fluid chamber.

2. The system according to claim 1, wherein the charge reducing unit comprises:

a filter unit configured to remove the charge directors from the fluid by adsorption to form a filtered fluid and provide the filtered fluid to the fluid chamber.

3. The system according to claim 2, wherein the filter unit comprises at least one of a silica gel and a mono-directional membrane.

4. The system according to claim 2, wherein the charge control unit comprises:

a fluid parameter detector configured to detect the at least one fluid parameter corresponding to the charge level of the fluid.

5. The system according to claim 4, further comprising:

an ink tank configured to receive fluid from the fluid chamber and toner concentrate to form a printing fluid, wherein the printing fluid is provided from the ink tank to the liquid electrophotography printing apparatus to enable images to be formed on a substrate.

6. The system according to claim 2, further comprising:

a charge increasing unit configured to increase the charge level of the fluid of the fluid chamber by providing a supplemental fluid to the fluid of the fluid chamber such that the concentration of the amount of the charge directors of the supplemental fluid is greater than the concentration of the amount of the charge directors of the fluid at the time of the detection of the at least one fluid parameter.

7. The system according claim 6, wherein the charge control unit further comprises:

a selector unit configured to select at least one of the charge reducing unit and the charge increasing unit to be in fluid communication with the fluid chamber based on the detection of the at least one fluid parameter.

8. The system according to claim 7, wherein the at least one fluid parameter is conductivity.

9. The system according to claim 8, wherein the selector unit is configured to select the charge reducing unit when the conductivity is greater than 110 pS/cm and select the charge increasing unit when the conductivity is less than 70 pS/cm.

10. The system according to claim 1, wherein the at least one fluid parameter is conductivity.

11. A method of controlling a charge level of fluid in a fluid chamber of a fluid delivery system, the method comprising:

detecting at least one fluid parameter corresponding to a charge level of a fluid having at least charge directors and carrier liquid in a fluid chamber; and controlling the charge level of the fluid in the fluid chamber by changing a concentration of an amount of the charge directors in the fluid based on the detected fluid parameter;

wherein a charge control unit controls the charge level of the fluid by selecting a charge reducing unit to be in fluid communication with the fluid chamber based on the detected at least one fluid parameter of the fluid such that the charge reducing unit reduces the concentration of the amount of the charge directors in the fluid by removing the charge directors from the fluid.

12. The method according to claim 11, wherein the at least one fluid parameter is conductivity.

13. The method according to claim 12, wherein the charge control unit further controls the charge level of the fluid by selecting a charge increasing unit to be in fluid communication with the fluid chamber based on the detected at least one fluid parameter of the fluid such that the charge increasing unit increases the concentration of the amount of charge directors in the fluid.

14. The method according to claim 13, wherein the charge control unit selects the charge reducing unit when the detected fluid parameter is greater than 110 pS/cm and selects the charge increasing unit when the detected fluid parameter is less than 70 pS/cm.

15. The method according to claim 13, wherein the concentration of the amount of the charge directors in the fluid is reduced by a filter unit removing respective charge directors from the fluid, the filter unit including at least one of a silica gel and a mono-directional membrane.

* * * * *

UNITED STATES PATENT AND TRADEMARK OFFICE

CERTIFICATE OF CORRECTION

PATENT NO. : 8,983,321 B2
APPLICATION NO. : 13/816467
DATED : March 17, 2015
INVENTOR(S) : Elliad Silcoff et al.

It is certified that error appears in the above-identified patent and that said Letters Patent is hereby corrected as shown below:

In the Claims

In column 7, line 47, in Claim 7, delete “according” and insert -- according to --, therefor.

Signed and Sealed this
Eleventh Day of August, 2015

Michelle K. Lee

Michelle K. Lee
*Director of the United States Patent and Trademark Office*